United States Patent [19]

Ishiguro et al.

[11] Patent Number: 4,642,858

[45] Date of Patent: Feb. 17, 1987

[54] BUCKLE APPARATUS

[75] Inventors: Kazuyoshi Ishiguro; Hidemoto Araki, both of Aichi, Japan

[73] Assignee: Kabushiki Kaisha Tokai Rika Denki Seisakusho, Aichi, Japan

[21] Appl. No.: 787,141

[22] Filed: Oct. 15, 1985

[30] Foreign Application Priority Data

Oct. 15, 1984 [JP] Japan ..... 59-155492[U]

[51] Int. Cl.[4] ..... A44B 11/26

[52] U.S. Cl. ..... 24/641; 24/639; 24/642

[58] Field of Search ..... 24/641, 642, 643, 647, 24/636, 637, 638, 639, 650, 652, 655, 656, 635

[56] References Cited

U.S. PATENT DOCUMENTS

| | | | |
|---|---|---|---|
| 3,969,795 | 7/1976 | Stephenson | 24/655 |
| 4,069,557 | 1/1978 | Loomba | 24/641 |
| 4,096,606 | 6/1978 | Stephenson | 24/641 |
| 4,228,567 | 10/1980 | Ikesue et al. | 24/642 |
| 4,310,952 | 1/1982 | Robben et al. | 24/641 |
| 4,339,854 | 7/1982 | Ikesue | 24/639 |
| 4,450,604 | 5/1984 | Oowada | 24/641 |
| 4,451,958 | 6/1984 | Robben et al. | 24/636 |
| 4,454,634 | 6/1984 | Haglund et al. | 24/641 |

FOREIGN PATENT DOCUMENTS

| | | | |
|---|---|---|---|
| 0040143 | 11/1981 | European Pat. Off. | 24/641 |
| 2073810 | 10/1981 | United Kingdom | 24/637 |

*Primary Examiner*—Victor N. Sakran

*Attorney, Agent, or Firm*—Sixbey, Friedman & Leedom

[57] ABSTRACT

A buckle apparatus for use in a seatbelt system is arranged such that when a tongue plate is inserted into a buckle body, the tongue plate retaining portion of a lock plate pivotally supported on one side of the tongue plate insertion passage extends through an opening formed in the tongue plate and projects out to the other side of the insertion passage so as to engage with a subsidiary lock plate. Accordingly, the lock plate which prevents the tongue plate from being undesirably pulled out is supported by the buckle body on both sides of the tongue plate and therefore can bear a large load. To release the tongue plate, the subsidiary lock plate is pivoted so as to disengage from the lock plate, which requires only a reduced force.

22 Claims, 5 Drawing Figures

BUCKLE APPARATUS

BACKGROUND OF THE INVENTION

1. Field of the Invention

The present invention relates to a buckle apparatus employed in a seatbelt system designed to protect an occupant of a vehicle in an emergency situation of the vehicle.

2. Description of the Related Art

A typical conventional buckle apparatus for use in a seatbelt system is arranged such that an occupant can be fastened by an occupant restraining webbing by engaging a tongue plate attached to an end or intermediate portion of the webbing with the buckle apparatus.

There are various types of buckle apparatus. One of them is a latch type buckle apparatus in which, as shown in FIG. 5, a tongue plate 12 is engaged with a lock member 10 which has its two ends respectively supported by members 14 which constitute the apparatus body. This latch type buckle apparatus has a large tongue plate holding strength and hence extremely high engagement reliability. In this buckle apparatus, disengagement of the tongue plate 12 is effected by sliding the lock member 10 upwardly as viewed in FIG. 5.

In this type of buckle apparatus, the tongue plate disengaging force, that is, the force F1 required to slide the lock member 10 when loaded, is represented by the following formula (1):

$$F1=(\mu 1+\mu 2)W \fallingdotseq 2\,\mu W \qquad (1)$$

where

W: webbing tension (load)

$\mu 1$: coefficient of friction between the lock member 10 and the members 14

$\mu 2$: coefficient of friction between the lock member 10 and the tongue plate 12

(it is assumed that $\mu 1=\mu 2=\mu$)

Accordingly, although the buckle apparatus of the type described above has a large tongue plate holding strength and hence extremely high engagement reliability, it also involves large frictional force, which leads to the disadvantage that a large force is required to disengage the tongue plate.

SUMMARY OF THE INVENTION

In view of the above circumstances, it is a primary object of the present invention to provide a buckle apparatus which has a large tongue plate holding strength and yet only requires a reduced force for disengaging the tongue plate.

To this end, the present invention provides a buckle apparatus in which a subsidiary lock plate and a lock plate which is formed with a tongue plate retaining portion are pivotally supported on a buckle body so as to face each other across the insertion passage of a tongue plate, the tongue plate retaining portion being pivoted from a flat position to an erect position in response to insertion of the tongue plate so as to engage with the subsidiary lock plate, and the tongue plate being retained by the intermediate portion of the tongue plate retaining portion in its erect position.

By virtue of the above arrangement, the tongue plate is retained by the intermediate portion of the tongue plate retaining portion which is supported at both ends thereof by the subsidiary lock plate and the buckle body, respectively, and therefore is held in place by an increased force. When the tongue plate is disengaged from the buckle apparatus, it is only necessary to disengage the subsidiary plate from the tongue plate retaining portion. Accordingly, frictional force occurs only at the sliding area between the subsidiary lock plate and the tongue plate retaining portion, which means that the force required to disengage the tongue plate from the buckle apparatus is advantageously reduced.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and in which.

DESCRIPTION OF THE PREFERRED EMBODIMENT

FIGS. 1 to 4 show in combination one embodiment of the buckle apparatus according to the present invention.

Figure 1:
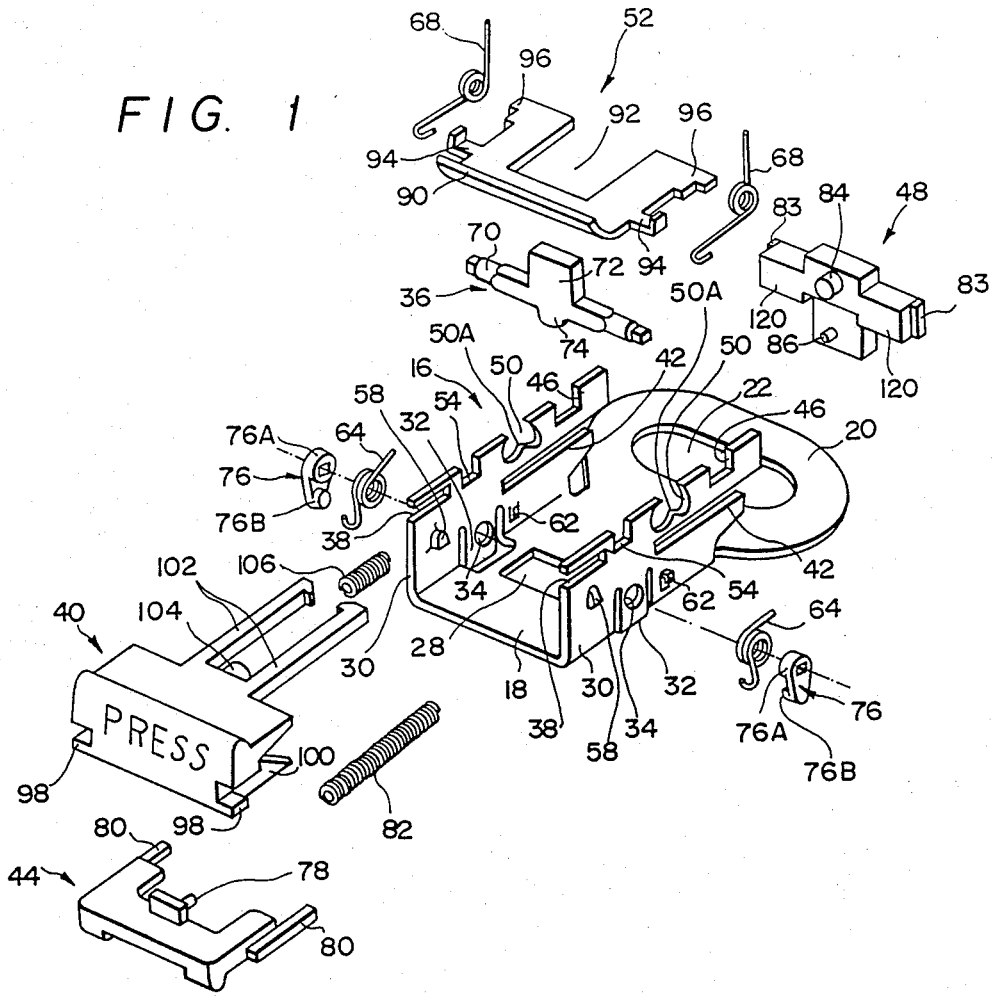
FIG. 1 is an exploded perspective view of one embodiment of the buckle apparatus according to the present invention.
Figure 2:
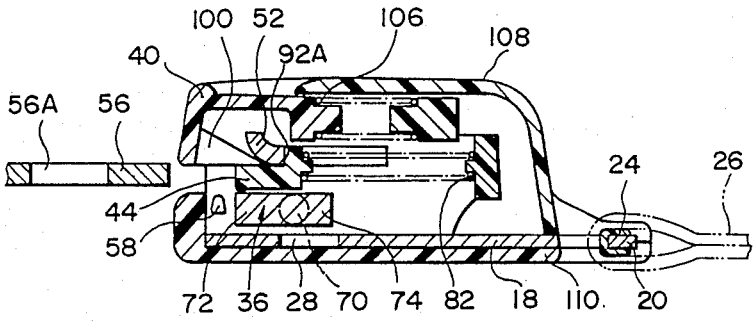
FIG. 2 is a sectional side elevational view of the buckle apparatus shown in FIG. 1 before the insertion of a tongue plate.

Referring first to FIG. 1, a buckle body 16 is formed from a single plate member with a predetermined strength. The rear end portion of a base portion 18 of the buckle body 16 is formed so as to provide a connecting portion 20 formed with an opening 22. One end of a strap 26 is connected to the connecting portion 20 through a protector 24, as shown in FIG. 2. The other end of the strap 26 is secured to the vehicle body through an anchor plate or the like.

An opening 28 is formed at the front end portion of the base portion 18. Leg portions 30 and 30 project from both lateral ends respectively of the front end portion of the base portion 18 so as to face each other. Bearing portions 32 and 32 are formed on the respective leg portions 30 and 30 by notching the leg portions 30 and 30 in such a manner that each bearing portion 32 is continuous with the buckle body 16 at only one of its four sides. The bearing portions 32 and 32 are respectively formed with bores 34 and 34 through which a lock plate 36 is pivotally supported. The leg portions 30 and 30 are further provided with the following various notches.

Notches 38 and 38 are formed in the respective front end faces of the leg portions 30 and 30 so as to serve as grooves for guiding a release button 40. Notches 42 and 42 are formed in the respective rear end faces of the leg portions 30 and 30 so as to serve as grooves for guiding an ejector 44. Notches 46 and 46 are formed in the respective upper end faces of the leg portions 30 and 30 so as to serve as grooves for mounting a spring holder 48. Notches 50 and 50 are also formed in the respective upper end faces of the leg portions 30 and 30 so as to support a subsidiary lock plate 52 in such a manner that it is pivotal about projections 50A and 50A which are respectively formed at the centers of the bottoms of the notches 50 and 50. Notches 54 and 54 are formed in front of the notches 50 and 50, respectively, so as to retain the respective lateral edge portions (retaining wings 94 and 94) formed at the distal end portion of the pivotal subsidiary lock plate 52.

The leg portions 30 and 30 respectively have projections 58 and 58 which project inwardly of the buckle body 16 and below the insertion passage of the tongue plate 56 (see FIG. 2) so as to guide the tongue plate 56 when being inserted and support the lower side of the inserted tongue plate 56. In addition, the leg portions 30 and 30 respectively have retaining projections 62 and 62 each formed by cutting and projecting outwardly a portion of the corresponding leg portion 30 and then bending the distal end portion of this projection. Torsion coil springs 64 and 64 for biasing the lock plate 36 so as to pivot are retained by the respective retaining projections 62 and 62.

The lock plate 36 has a shaft portion 70, a tongue plate retaining portion 72 and a stopper portion 74. Both end portions of the shaft portion 70 are formed into circular shaft portions, and the distal end portion of each circular portion is formed into a rectangular shaft portion. The circular shaft portions at both ends of the shaft portion 70 are respectively received by the bores 34 and 34 formed in the leg portions 30 and 30 of the buckle body 16, whereby the lock plate 36 is pivotally supported.

The rectangular shaft portions of the shaft portion 70 project outwardly from the leg portions 30 and 30, respectively, and spring holders 76 and 76 are respectively fitted onto the rectangular shaft portions so as to be retained thereby. Each spring holder 76 is formed with a boss portion 76A with a rectangular bore formed in its center and a retaining portion 76B. Each of the rectangular shaft portions of the shaft portion 70 is fitted into the rectangular bore in the boss portion 76A of the corresponding spring holder 76. The respective coil portions of torsion coil springs 64 and 64 are fitted onto the boss portions 76A and 76A of the corresponding spring holders 76 and 76. The arm portion at one end of each torsion coil spring 64 is retained by the retaining portion 76B of the corresponding spring holder 76, while the arm portion at the other end is retained by the corresponding retaining projection 62. The lock plate 36 is biased by the torsion coil springs 64 and 64 so as to pivot clockwise as viewed in FIGS. 2 to 4.

The ejector 44 is formed with a spring retaining projection 78 and guide rails 80 and 80. The ejector 44 is inserted into the buckle body 16 from the rear of the body 16 in such a manner that the guide rails 80 and 80 are slidably fitted into the respective notches 42 of the leg portions 30 and 30.

The spring holder 48 has its body formed with retaining projections 83 and 83 and spring retaining projections 84 and 86. The spring holder 48 is mounted on the buckle body 16 in such a manner that both side portions 120 and 120 of the body of the spring holder 48 are fitted into the respective notches 46 and 46 of the leg portions 30 and 30. A compression coil spring 82 is disposed between the spring retaining projection 86 of the spring holder 48 and the spring retaining projection 78 of the ejector 44. Thus, the ejector 44 is biased by means of the compression coil spring 82 so as to move leftwardly as viewed in FIGS. 2 to 4.

The subsidiary lock plate 52 is formed with a curved portion 90, a notch 92, retaining wings 94 and 94, and stepped projections 96 and 96. The subsidiary lock plate 52 is mounted on the buckle body 16 in such a manner that the respective proximal portions of the stepped projections 96 and 96 are fitted into the notches 50 and 50 of the leg portions 30 and 30 so that the subsidiary lock plate 52 is pivotal about the projections 50A and 50A. The respective coil portions of torsion coil springs 68 and 68 are fitted onto the respective distal end portions of the projections 96 and 96. The arm at one end of each torsion coil spring 68 is retained by the corresponding retaining wing 94, while the arm at the other end of the spring 68 is retained by one of the corresponding retaining projections 83 and 83 of the spring holder 48. The subsidiary lock plate 52 is biased by means of the torsion coil springs 68 and 68 so as to pivot counterclockwise as viewed in FIGS. 2 to 4. The counterclockwise pivotal motion of the subsidiary lock plate 52 is limited by the retaining wings 94 and 94 abutting against the respective bottom surfaces of the notches 54 and 54.

The release button 40 is formed with guide projections 98 and 98, wedge-shaped projections 100 and 100 for unlocking, fork-like retaining legs 102 and 102 each having a hooked distal end, and a spring retaining projection 104. The release button 40 is mounted on the buckle body 16 in such a manner that the guide projections 98 and 98 are slidably fitted into the respective notches 38 and 38 of the leg portions 30 and 30. A compression coil spring 106 is disposed between the spring retaining projection 104 and the spring retaining projection 84 of the spring holder 48. The release button 40 is biased by means of the compression coil spring 106 so as to move leftwardly as viewed in FIGS. 2 to 4. The leftward movement of the release button 40 is limited by the hooked distal ends of the retaining legs 102 and 102 which respectively abut against stepped portions 121 and 121 formed on the spring holder 48.

Upper and lower covers 108 and 110 are fitted to each other in such a manner that the buckle body 16 is covered thereby, as shown in FIG. 2.

The following is a description of the operation of this embodiment.

FIG. 2 shows the buckle apparatus before the tongue plate 56 is inserted thereinto. Under this state, the ejector 44 which is biased by means of the compression coil spring 82 is positioned at the extremity of its advancement. The lock plate 36 is biased by means of the torsion coil springs 64 and 64 so as to pivot clockwise but is prevented from pivoting by the ejector 44; hence, the tongue plate retaining portion 72 remains in its flat position.

The subsidiary lock plate 52 is biased by means of the torsion coil springs 68 and 68 so as to pivot counterclockwise. However, the retaining wings 94 and 94 which abut against the respective bottoms of the notches 54 and 54 prevent the subsidiary lock plate 52 from pivoting. The release button 40 which is biased by means of the compression coil spring 106 is positioned at the extremity of its advancement.

The tongue plate 56 is inserted into the buckle apparatus under this set of conditions from the inlet of the tongue plate insertion passage which is defined by the gap between the respective bottom surfaces of the wedge-shaped projections 100 and 100 of the release button 40 and the projections 58 and 58 respectively formed on the leg portions 30 and 30. On being inserted, the tongue plate 56 presses the ejector 44 rightwardly against the biasing force of the compression coil spring 82. When the ejector 44 is moved rightwardly by the pressure from the tongue plate 56, the lock plate 36 begins to pivot clockwise by means of the biasing force of the torsion coil spring 64.

As the lock plate 36 pivots, the tongue plate retaining portion 72 enters the insertion passage of the tongue plate 56. Since the opening 56A formed in the tongue plate 56 is positioned at this portion of the insertion passage, the tongue plate retaining portion 72 is allowed to move through the opening 56A, and the lock plate 36 is thus permitted to pivot further. When the distal end of the tongue plate retaining portion 72 has come out of the opening 56A, it abuts and presses against the subsidiary lock plate 52. The subsidiary lock plate 52 is subjected to the rotational forces of the torsion coil springs 64 and 64. However, this rotational force is set such as to be smaller than that being applied to the lock plate 36.

Accordingly, the lock plate 36 overcomes the rotational force being applied to the subsidiary lock plate 52, thus causing the plate 52 to pivot clockwise. The lock plate 36 further pivots until the tongue plate retaining portion 72 enters the notch 92 of the subsidiary lock plate 52. In consequence, the subsidiary lock plate 52 is disengaged from the lock plate 36 and pivots counterclockwise until the retaining wings 94 and 94 abut against the respective bottoms of the notches 54 and 54.

The lock plate 36 is prevented from pivoting clockwise by the stopper portion 74 which abuts and presses against the end face of the opening 28 formed in the base portion 18 of the buckle body 16. When the insertion of the tongue plate 56 has been completed and the pushing force applied to the tongue plate 56 is removed, the plate 56 is pressed by the ejector 44 and moved reversely, that is, leftwardly.

Since the biasing force applied to the ejector 44 is set such as to be larger than the biasing force applied to the lock plate 36 so as to pivot, the ejector 44 can move leftwardly, thus causing the lock plate 36 to pivot counterclockwise through the tongue plate 56. As soon as the lock plate 36 is pivoted counterclockwise, the tongue plate retaining portion 72 abuts against the end face 92A of the notch 92 of the subsidiary lock plate 52, whereby the lock plate 36 ceases pivoting.

Figure 3:
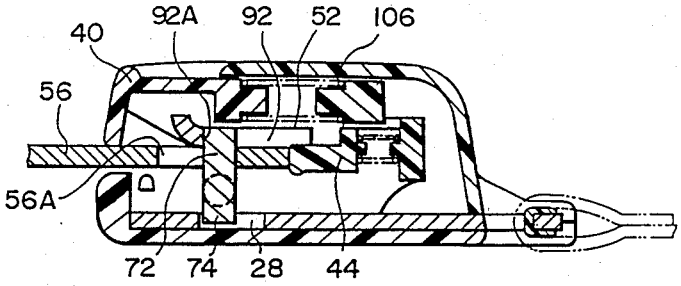
FIG. 3 is a sectional side elevational view of the buckle apparatus shown in FIG. 1 with the tongue plate inserted therein.

This state is shown in FIG. 3, in which the tongue plate 56 is retained by the intermediate portion of the tongue plate retaining portion 72 in its erect position. In this state, the tongue plate retaining portion 72 has the tongue plate 56 positioned at its intermediate portion and is supported at its two ends. More specifically. the upper end of the tongue plate retaining portion 72 is engaged with and supported by the subsidiary lock plate 52, and the lower end thereof is supported by the buckle body 16 through the shaft portion 70.

Figure 4:
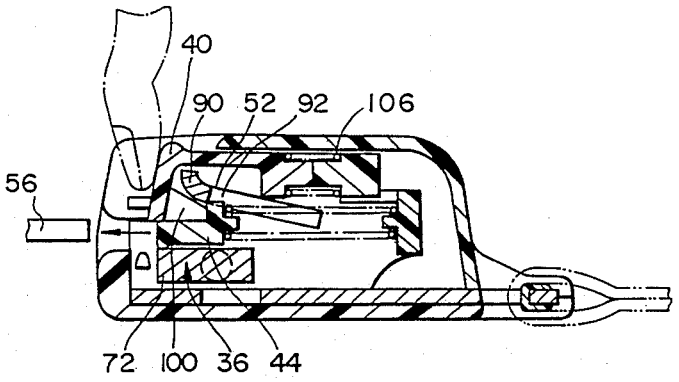
FIG. 4 is a sectional side elevational view of the buckle apparatus shown in FIG. 1 immediately after the disengagement of the tongue plate.
Figure 5:
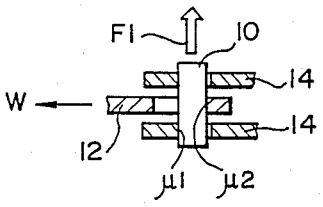
FIG. 5 shows the principle of a conventional buckle apparatus.

To disengage the tongue plate 56, the release button 40 is moved rightwardly against the biasing force of the compression coil spring 106. When the release button 40 is moved rightwardly, the wedge-shaped projections 100 and 100 formed on the release button 40 abut against the reverse surface of the curved portion 90 of the subsidiary lock plate 52, thus causing the distal end portion of the plate 52 to be pushed upwardly, as shown in FIG. 4. In consequence, the lock plate 36 is disengaged from the subsidiary lock plate 52.

Since the biasing force applied to the lock plate 36 so as to pivot is smaller than the biasing force applied to the ejector 44 as described above, the lock plate 36 when disengaged is pressed by the ejector 44 through the tongue plate 56 so as to pivot counterclockwise. The ejector 44 advances leftwardly while pressing the tongue plate 56, thus ejecting the tongue plate 56 out of the buckle apparatus. This state is shown in FIG. 4, in which the tongue plate retaining portion 72 of the lock plate 36 is in its flat position. The ejector 44 is positioned at the extremity of its advancement.

When the release button 40 in the state shown in FIG. 4 is released, it is moved by means of the biasing force of the compression coil spring 106 so as to return to the extremity of its advancement. As the release button 40 is thus moved, the subsidiary lock plate 52 is released from the restraint by the wedge-shaped projections 100 and 100. The subsidiary lock plate 52 is therefore pivoted counterclockwise by means of the biasing forces of the torsion coil springs 68 and 68 to reach the position shown in FIG. 2.

Thus, in this embodiment, the tongue plate 56 is retained by the intermediate portion of the tongue plate retaining portion 72 which is supported at its two ends. Accordingly, the buckle apparatus has a large tongue plate holding strength and hence extremely high engagement reliability. Although the force which is applied to the tongue plate 56 in the direction in which it is pulled out acts on the subsidiary lock plate 52, since the stepped projections 96 and 96 of the subsidiary lock plate 52 which serve as the pivot of the plate 52 are located in the vicinity of the prolongation of the tongue plate insertion passage, the above-mentioned force mainly acts on the projections 96, and only a very small force acts on the subsidiary lock plate 52 in the direction in which it is disengaged from the tongue plate retaining portion 72. In addition, it is unnecessary to apply a large force for disengaging the tongue plate 56, since frictional force occurs only at the sliding area between the tongue plate retaining portion 72 and the subsidiary lock plate 52. The force required for disengaging the tongue plate 56 is particularly reduced in this embodiment, since the subsidiary lock plate 52 is disengaged from the tongue plate retaining portion 72 by virtue of the wedge action provided by the wedge-shaped projections 100 and 100 formed on the release button 40.

It is to be noted that the stopper portion 74 formed on the lock plate 36 may be omitted, but the existence of the stopper portion 74 intensifies the strength of the shaft portion 70.

As has been described above, the buckle apparatus in accordance with this embodiment is arranged such that the subsidiary lock plate and the lock plate which is formed with the tongue plate retaining portion are pivotally supported on the buckle body so as to face each other across the insertion passage of the tongue plate, the tongue plate retaining portion being pivoted from its flat position to its erect position in response to insertion of the tongue plate so as to engage with the subsidiary lock plate, and the tongue plate being retained by the intermediate portion of the tongue plate retaining portion in its erect position. Accordingly, the buckle apparatus of the present invention has a large tongue plate holding strength and yet only requires a reduced force for disengaging the tongue plate.

What is claimed is:

1. A buckle apparatus for engagement with a tongue plate having an opening which is employed in a seatbelt system designed to protect an occupant of a vehicle in an emergency situation of the vehicle, comprising:

(a) a buckle body mounted on the vehicle body having an insertion passage for receiving said tongue plate;

(b) a lock member having a tongue plate retaining portion, said lock member being pivotally mounted on said buckle body at a first side of the insertion passage of said buckle body, said lock member being able to pivot until its tongue plate retaining portion extends through the opening in said tongue plate in a projecting position toward a second side of said insertion passage to latch said tongue plate when said tongue plate is received within the insertion passage of the buckle body;

(c) a subsidiary lock member pivotally mounted on said buckle body at said second side of said insertion passage so as to engage with the distal end of said tongue plate retaining portion in its projecting position, wherein the tongue plate is retained by an intermediate section of said tongue plate retaining portion of said lock member, and said lock member is supported by the subsidiary lock member and the portion of the buckle body that pivotally mounts the lock member, so that said tongue plate is prevented from being undesirably pulled out of said buckle body; and (d) a release member actuated for disengaging said subsidiary lock member from said tongue plate to retaining portion, thereby allowing said tongue plate to be pulled out of said buckle body.

2. A buckle apparatus according to claim 1, wherein said lock member is pivotally biased by a biasing means in the direction in which said tongue plate retaining portion enters the insertion passage of said buckle body.

3. A buckle apparatus according to claim 2, further comprising means for biasing said subsidiary lock member in the direction in which it engages with said lock member.

4. A buckle apparatus according to claim 3, wherein the biasing force applied to said lock member is larger than that applied to said subsidiary lock member, so that said lock member causes said subsidiary lock member to pivot so as to engage therewith.

5. A buckle apparatus according to claim 4, wherein said subsidiary lock member is formed with a curved portion against which the distal end portion of said lock member abuts.

6. A buckle apparatus according to claim 1, wherein said lock member has said tongue plate retaining portion projecting from the center between a pair of pivot portions through which said lock member is pivotally supported by said buckle body.

7. A buckle apparatus according to claim 6, wherein said lock member has portions for mounting respective springs which apply biasing forces to said lock member so as to pivot, said portions being provided adjacent to said pivot portions.

8. A buckle apparatus according to claim 7, wherein each of said pivot portions of said lock member is pivotally supported by a portion of said buckle body formed by notching said buckle body in such a manner that said portion is continuous with said buckle body at only one of its four sides.

9. A buckle apparatus according to claim 1, wherein said subsidiary lock member is formed with a notch portion, so that the distal portion of said tongue plate retaining portion is engaged with the notch portion after is passes through the opening of the tongue plate.

10. A buckle apparatus for engagement with a tongue plate which is employed in a seatbelt system designed to protect an occupant of a vehicle in an emergency situation of the vehicle, comprising:

(a) a buckle body having first and second opposing sides that is mounted on the vehicle body and that has an insertion passage for receiving said tongue plate;

(b) a lock member that is pivotally mounted on the buckle body at the first side of the insertion passage, said lock member including a tongue plate retaining portion that is centrally disposed between a pair of pivot portions, wherein each of the pivot portions is pivotally mounted within a portion of said buckle body formed by notching the buckle body such that each said portion is continuous with said buckle body at only one of its sides, and wherein said lock member further includes portions adjacent to said pivot portions for mounting springs thereon for applying forces onto said member in the direction in which the tongue plate retaining portion enters the insertion passage of the buckle body so that the tongue plate retaining portion extends through the tongue plate and projects into another side of the insertion passage when said tongue plate is inserted into said buckle body;

(c) a subsidiary lock member pivotally mounted on said buckle body so as to engage with the tongue plate retaining portion in its projecting position, said subsidiary lock member having (i) a curved portion against which the distal end of the tongue retaining portion of the lock member abuts when said tongue plate is received within the insertion passage of the buckle body, and (ii) means for biasing said subsidiary lock member in the direction in which it engages the tongue retaining portion, wherein the biasing force applied to the lock member by said springs is larger than that applied by said biasing means to the subsidiary lock member so that the lock member causes the subsidiary lock member to pivot and engage therewith when said tongue plate is received within said insertion passage of said buckle body, and (d) a release member actuated for disengaging said subsidiary lock member from said tongue plate retaining portion, thereby allowing said tongue plate to be pulled out of said buckle body, wherein said lock member further has a stopper portion provided on the side thereof which is remote from said tongue plate retaining portion, said stopper portion facing said buckle body when said lock member and said tongue plate are in engagement with each other, so that said stopper portion engages with said buckle body when said tongue plate is subjected to a large force which acts such as to pull out said tongue plate from said buckle body, thereby intensifying the tongue plate holding strength of said lock member.

11. A buckle apparatus according to claim 10, wherein the portion of said buckle body which engages with said stopper portion is an opening formed in said buckle body.

12. A buckle apparatus according to claim 10, wherein said subsidiary lock member is constituted by a plate member which pivots about a pair of projections formed at both lateral ends thereof which are respectively inserted into recesses formed in said buckle body.

13. A buckle apparatus according to claim 12, wherein said pair of projections of said subsidiary lock member also serve as portions for mounting respective springs which bias said subsidiary lock member so as to pivot.

14. A buckle apparatus according to claim 11, wherein said subsidiary lock member has a notch for engagement with said lock member.

15. A buckle apparatus according to claim 14, wherein the center of pivotal motion of said subsidiary lock member is located in the vicinity of the prolongation of said tongue plate insertion passage, so that the force applied to said tongue plate in the direction in which it is pulled out of said buckle body acts on the vicinity of the center of pivotal motion of said subsidiary lock member.

16. A buckle apparatus according to claim 10, wherein said release member is provided with a wedge member for pivoting said subsidiary lock member.

17. A buckle apparatus for engagement with a tongue plate which is employed in a seatbelt system, said apparatus comprising:

(a) a buckle body having an insertion passage for receiving said tongue plate;

(b) a lock member pivotally mounted on one side of the insertion passage of said tongue plate, said lock member having a tongue plate retaining portion centrally disposed between a pair of pivot portions, each of which is pivotally mounted on a portion of the buckle body that is formed by notching the buckle body in such a manner that the portion is continuous with the buckle body at only one of its sides, said lock member further being able to pivot to a lock position at which its tongue plate retaining portion extends through an opening formed in said tongue plate so as to project out to the other side of said insertion passage and having means for biasing the lock member in the direction in which the tongue plate retaining portion enters the insertion passage of the buckle body;

(c) a subsidiary lock member pivotally supported on the other side of said tongue plate insertion passage and in the vicinity of the prolongation of said insertion passage so as to extend substantially along said insertion passage, said subsidiary lock member engaging with said tongue plate retaining portion in its projecting position and having a curved portion against which the distal end portion of the tongue plate retaining portion of the lock member abuts, and including means for biasing the subsidiary lock member in the direction in which it engages with the lock member, wherein the biasing force applied to the subsidiary lock member is less than the biasing force applied to the lock member so that the lock member causes the subsidiary lock member to pivot so as to engage therewith, and (d) release means for disengaging said subsidiary lock member from said lock member by pivoting said subsidiary lock member, wherein said lock member has a stopper portion provided on the side thereof which is remote from said tongue plate retaining porton, said stopper portion facing said buckle body when said lock member and said tongue plate are in engagement with each other, so that said stopper portion engages with said buckle body when said tongue plate is subjected to a large force which acts such as to pull out said tongue plate from said buckle body, thereby intensifying the tongue plate holding strength of said lock member.

18. A buckle apparatus according to claim 17, wherein the portion of said buckle body which engages with said stopper portion is an opening formed in said buckle body.

19. A buckle apparatus according to claim 18, wherein said subsidiary lock member is constituted by a plate member which pivots about a pair of projections formed at both lateral ends thereof which are respectively inserted into recesses formed in said buckle body.

20. A buckle apparatus according to claim 17, wherein said release means is provided with a wedge member for pivoting said subsidiary lock member.

21. A buckle apparatus comprising:

(a) a buckle body that includes an insertion passage having two sides;

(b) a tongue plate insertable into the passage of the buckle body and formed with an engagement opening;

(c) a lock plate having a pivot portion pivotally supported on said buckle body and at one side of the insertion passage of said tongue plate, a tongue plate retaining portion projecting from said pivot portion, and means for rotatably biasing the lock plate in such a direction so that when said lock plate pivots, said tongue plate retaining portion extends across the insertion passage and through said tongue plate and projects out to the other side of said tongue plate insertion passage; and (d) a subsidiary lock plate disposed on said buckle body and in the vicinity of the prolongation of said tongue plate insertion passage so as to extend along said insertion passage toward a tongue plate insertion opening formed in said buckle body, said subsidiary lock plate having a portion which extends with said tongue plate retaining portion in its projecting position, and a means for biasing the subsidiary lock plate in the direction in which it engages with the lock plate, but with a biasing force that is less than the biasing force applied to the lock plate so that the lock plate causes the subsidiary lock plate to pivot so as to engage therewith, wherein said lock plate has a stopper portion provided on the side thereof which is remote from said tongue plate retaining portion, said stopper portion facing said buckle body when said lock plate and said tongue plate are in engagement with each other, so that said stopper portion engages with said buckle body when said tongue plate is subjected to a large force which acts such as to pull out said tongue plate from said buckle body, thereby intensifying the tongue plate holding strength of said lock plate.

22. A buckle apparatus for engagement with a tongue plate having an opening that is particularly adapted for use in a seatbelt system for a vehicle, comprising:

(a) a buckle body mounted on the vehicle body that has an insertion passage for receiving the tongue plate;

(b) a lock member having a tongue plate retaining portion with an intermediate section and a distal end that is insertable through the opening in the tongue plate, said tongue plate retaining portion being pivotally mounted on the buckle body on a first side of the insertion passage and being pivot-able into a position extending across the insertion passage with said intermediate section thereof extending through said opening in the tongue plate and said distal end projecting into an opposing side of the insertion passage;

(c) a subsidiary lock member pivotally mounted on the buckle body at the opposing side of the insertion passage and having an opening for receiving the distal end of the tongue plate retaining portion and for stopping the tongue plate retaining portion from further pivotal movement;

(d) a release member for pivotally disengaging the subsidiary lock member from the projecting portion of the distal end of the tongue plate retaining portion, thereby allowing the tongue plate to be pulled out of the insertion passage, whereupon said tongue plate is retained within the insertion passage by the intermediate section of said tongue plate retaining portion of said lock member, which in turn is supported at either end at opposing sides of the buckle body.

* * * * *